US008827258B2

(12) United States Patent
Miki

(10) Patent No.: US 8,827,258 B2
(45) Date of Patent: Sep. 9, 2014

(54) RECORDING MEDIUM TRANSPORT DEVICE, AND IMAGE FORMING APPARATUS

(71) Applicant: Kyocera Document Solution Inc., Osaka (JP)

(72) Inventor: Masafumi Miki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/017,757

(22) Filed: Sep. 4, 2013

(65) Prior Publication Data

US 2014/0061997 A1 Mar. 6, 2014

(30) Foreign Application Priority Data

Sep. 4, 2012 (JP) ..... 2012-194271

(51) Int. Cl.
*B65H 5/22* (2006.01)
*B65H 5/06* (2006.01)
*G03G 15/00* (2006.01)

(52) U.S. Cl.
CPC ..... *B65H 5/062* (2013.01); *G03G 15/6529* (2013.01); *G03G 15/6567* (2013.01)
USPC ..... 271/4.04; 271/270; 271/264

(58) Field of Classification Search
USPC ..... 271/4.04, 10.04, 264, 270, 272
See application file for complete search history.

(56) References Cited

U.S. PATENT DOCUMENTS 6,530,569 B2 * 3/2003 Yamagishi ..... 271/270
7,971,878 B2 * 7/2011 Hashimoto et al. ..... 271/274
8,465,013 B2 * 6/2013 Ashikawa ..... 271/3.18

FOREIGN PATENT DOCUMENTS

JP 11-275896 10/1999

* cited by examiner

*Primary Examiner* — Michael McCullough
(74) *Attorney, Agent, or Firm* — K&L Gates LLP

(57) ABSTRACT

A recording medium transport device includes a connecting member that connects two transport roller pairs, and a drive switching section that is provided to one of the two transport roller pairs, and switches between a state in which a rotational drive force is transmitted between the two transport roller pairs via the connecting member and a state in which the rotational drive force is not transmitted between the two transport roller pairs. A controller of the recording medium transport device causes the drive switching section to switch from the state in which the rotational drive force is not transmitted between the two transport roller pairs to the state in which the rotational drive force is transmitted between the two transport roller pairs via the connecting member, when the rotational speed of at least one of the transport roller pairs falls outside a predetermined speed range.

8 Claims, 6 Drawing Sheets

RECORDING MEDIUM TRANSPORT DEVICE, AND IMAGE FORMING APPARATUS

INCORPORATION BY REFERENCE

This application is based upon and claims the benefit of priority from the corresponding Japanese Patent Application No. 2012-194271, filed Sep. 4, 2012, the entire contents of which are incorporated herein by reference.

BACKGROUND

The present disclosure relates to a recording medium transport device and an image forming apparatus. More specifically, the present disclosure relates to a technique for controlling the driving of transport roller pairs during transport of a recording medium.

A recording paper transport mechanism used in an apparatus such as an image forming apparatus is provided with multiple transport roller pairs that transport recording paper. A stepping motor that enables high-precision rotation control is used as a drive source for each of the transport roller pairs. In a case where the recording paper is transported by rotating the transport roller pairs by a driving force from the stepping motor, when a difference occurs between the rotational speeds of the transport roller pairs in the transport path of the recording paper, one of the following situations may result in some cases: (1) transport roller pairs pinching a single sheet of recording paper pull on the recording paper against each other; and (2) when the leading edge of the recording paper pinched by a transport roller pair that rotates at high speed goes in between the other transport roller pair that rotates at low speed, the leading edge of the recording paper is pushed into the other transport roller pair. In these situations, a greater load is exerted on the stepping motor that rotates each of the transport roller pairs, which may result in a step out of the stepping motor. A control used to prevent such step out of the stepping motor, is to increase the torque of the stepping motor when one of these situations ((1) and (2)) occurs. The following technique exists as an example of such a control. According to this technique, the number of excited phases of the stepping motor is increased/decreased in accordance with the torque required for the stepping motor, thereby rotationally driving the stepping motor while switching combinations of simultaneously excited phases.

However, the above-mentioned technique has the following problem. If the technique is used to increase torque by increasing the number of excited phases based on the load exerted on the transport roller pairs, output current increases. Consequently, the power consumption of the stepping motor increases, and also the motor temperature rises.

SUMMARY

A recording medium transport device according to an embodiment of the present disclosure includes a transport path along which a recording medium is transported, two transport roller pairs, two stepping motors, a rotational speed detecting section, a connecting member, a drive switching section, and a controller. The two transport roller pairs are located at different positions on the transport path in the transport direction of the recording medium, and transport the recording medium. A stepping motor is provided for each one of the two transport roller pairs respectively, and supplies a rotational drive force to each one of the two transport roller pairs respectively. The rotational speed detecting section detects the rotational speed of at least one of the two transport roller pairs. The connecting member connects the two transport roller pairs. The drive switching section is provided to one of the two transport roller pairs, and switches between a state in which the rotational drive force is transmitted between the two transport roller pairs via the connecting member, and a state in which the rotational drive force is not transmitted between the two transport roller pairs. The controller causes the drive switching section to switch from the state in which the rotational drive force is not transmitted between the two transport roller pairs to the state in which the rotational drive force is transmitted between the two transport roller pairs via the connecting member, when the rotational speed detected by the rotational speed detecting section falls outside a predetermined speed range.

An image forming apparatus according to another embodiment of the present disclosure includes a paper feeding section that feeds a recording medium to a transport section, the transport section, and an image forming section. The transport section transports the recording medium fed from the paper feeding section, and includes a recording medium transport device. The image forming section forms a toner image on the recording medium transported by the transport section. The recording medium transport device includes a transport path along which a recording medium is transported, two transport roller pairs, two stepping motors, a rotational speed detecting section, a connecting member, a drive switching section, and a controller. The two transport roller pairs are located at different positions on the transport path in the transport direction of the recording medium, and transport the recording medium. A stepping motor is provided for each one of the two transport roller pairs respectively, and supplies a rotational drive force to each one of the two transport roller pairs respectively. The rotational speed detecting section detects the rotational speed of at least one of the two transport roller pairs. The connecting member connects the two transport roller pairs. The drive switching section is provided to one of the two transport roller pairs, and switches between a state in which the rotational drive force is transmitted between the two transport roller pairs via the connecting member, and a state in which the rotational drive force is not transmitted between the two transport roller pairs. The controller causes the drive switching section to switch from the state in which the rotational drive force is not transmitted between the two transport roller pairs to the state in which the rotational drive force is transmitted between the two transport roller pairs via the connecting member, when the rotational speed detected by the rotational speed detecting section falls outside a predetermined speed range.

Additional features and advantages are described herein, and will be apparent from the following Detailed Description and the figures.

DETAILED DESCRIPTION

Figure 1:
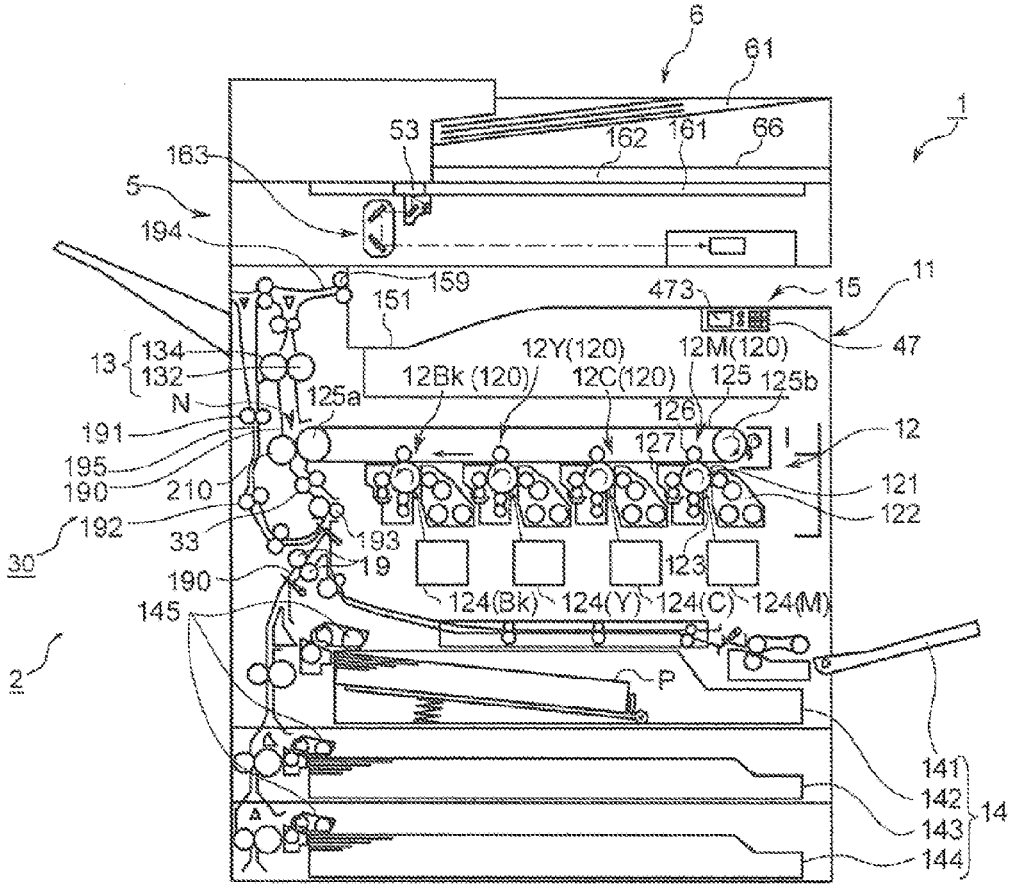
FIG. 1 illustrates an image forming apparatus according to an embodiment of the present disclosure.

Hereinafter, a recording medium transport device and an image forming apparatus including the recording medium transport device according to an embodiment of the present disclosure will be described with reference to the drawings. FIG. 1 illustrates an image forming apparatus 1 according to an embodiment of the present disclosure.

The image forming apparatus 1 according to an embodiment of the present disclosure is a multi-functional peripheral that is equipped with multiple functions such as a copy function, a printer function, a scanner function, and a facsimile function. The image forming apparatus 1 includes an apparatus body 11, a document feeder 6, and an image reader 5. The apparatus body 11 includes an operating section 47, an image forming section 12, a fixing section 13, and a paper feeding section 14, and the like.

The operating section 47 includes a touch panel section and an operating key section which accept instructions from an operator for various operations and processing that can be executed by the image forming apparatus 1. The touch panel section includes a display 473 such as a liquid crystal display (LCD) having a touch panel function.

The image reader 5 includes a contact glass 161, a document pressing cover 162, and a reading mechanism 163. The contact glass 161 is used to place a document thereon. The document pressing cover 162 presses down a document placed on the contact glass 161 and can be opened and closed. The reading mechanism 163 reads the image of a document placed on the contact glass 161. The reading mechanism 163 includes a photo-irradiation section (not illustrated) as the light source having a LED that emits light toward the document, an image sensor (not illustrated) such as a CCD sensor, and an optical system. The optical system includes multiple mirrors (not illustrated), a condenser lens (not illustrated), and the like, and is movable between a position below a document reading slit 53 and a document reading position that is below the contact glass 161. The reading mechanism 163 optically reads the image of the document, and generates image data. The generated image data is used for image formation by the image forming section 12, or for storage into a hard disk drive (HDD) 92 described later.

The document feeder 6 includes a feed roller pair (not illustrated) and a transport roller pair (not illustrated). By driving these roller pairs, the document feeder 6 feeds the document placed on a document placing section 61 one sheet at a time. Then, the document feeder 6 transports the document to a position opposite to the document reading slit 53, thereby allowing the document to be read by the reading mechanism 163 of the image reader 5 via the document reading slit 53. Thereafter, the document feeder 6 discharges the document to a document discharge section 66. The reading mechanism 163 reads the document being transported at a feed document reading position located below the document reading slit 53.

The paper feeding section 14 includes paper feed cassettes 142, 143, and 144 that can be inserted into and removed from the apparatus body 11.

The image forming section 12 performs an image forming operation for forming a toner image on recording paper P, fed from the paper feeding section 14, as a recording medium. The image forming section 12 includes a magenta image forming unit 12M that uses toner of magenta color, a cyan image forming unit 12C that uses toner of cyan color, a yellow image forming unit 12Y that uses toner of yellow color, a black image forming unit 12Bk that uses toner of black color, an intermediate transfer belt 125, and a secondary transfer roller 210. The magenta, cyan, yellow, and black image forming units 12M, 12C, 12Y, and 12Bk are located in the stated order in the direction of movement of the intermediate transfer belt 125. The intermediate transfer belt 125 is an endless belt. The intermediate transfer belt 125 is stretched among multiple rollers such as a driving roller 125*a* so as to be able to move in the sub-scanning direction for image formation. The secondary transfer roller 210 abuts against the outer peripheral surface of the intermediate transfer belt 125 at a position where the intermediate transfer belt 125 is stretched around the driving roller 125*a*. In the following description, when individual image forming units are described without being distinguished from one another, each of the image forming units will be referred to as "image forming unit 120".

Each of the image forming units 120 includes a photoconductor drum 121, a developing device 122, a toner cartridge (not illustrated) that stores toner, a charging device 123, an exposure device 124, a primary transfer roller 126, and a drum cleaning device 127. The developing device 122 supplies toner to the photoconductor drum 121.

The intermediate transfer belt 125 is positioned above each photoconductor drum 121. The intermediate transfer belt 125 has, on its outer peripheral surface, an image bearing surface to which a toner image is transferred. The intermediate transfer belt 125 is rotationally driven by the driving roller 125*a* while abutting against the peripheral surfaces of the photoconductor drums 121. The intermediate transfer belt 125 moves between the driving roller 125*a* and a driven roller 125*b*, in synchronization with the rotation of each photoconductor drum 121.

The primary transfer roller 126 is positioned at a position opposite to each photoconductor drum 121 so as to interpose the intermediate transfer belt 125 therebetween. The primary transfer roller 126 transfers the above-mentioned toner image formed on the outer peripheral surface of each photoconductor drum 121 to the surface of the intermediate transfer belt 125.

A controller 100 (see FIG. 4) controls the drive of each of the image forming units 120 including the primary transfer roller 126 and corresponding to each color, thereby causing the image forming units 120 to transfer a magenta toner image formed by the magenta image forming unit 12M to the surface of the intermediate transfer belt 125, to transfer a cyan toner image formed by the cyan image forming unit 12C to the same position on the intermediate transfer belt 125, to transfer a yellow toner image formed by the yellow image forming unit 12Y to the same position on the intermediate transfer belt 125, and lastly, to transfer a black toner image formed by the black image forming unit 12Bk to the same position on the intermediate transfer belt 125 in the stated order so that the toner images of these colors are superimposed on one another. As a result, a color toner image is formed on the surface of the intermediate transfer belt 125 (intermediate transfer (first transfer)).

A transfer bias is applied to the secondary transfer roller 210 by a transfer bias applying mechanism (not illustrated). The secondary transfer roller 210 transfers the color toner image formed on the surface of the intermediate transfer belt 125 to the recording paper P that has been transported along a transport path 190 from the paper feeding section 14, in a nip part N located between the secondary transfer roller 210 and the driving roller 125*a* with the intermediate transfer belt 125 interposed therebetween.

The transport path 190 that extends in the vertical direction is located at a location to the left of the image forming section 12 in FIG. 1. In the transport path 190, multiple transport roller pairs 19 are located at suitable positions. The transport roller pairs 19 transport the recording paper P fed from the paper feeding section 14 toward the nip part N and the fixing section 13. The transport path 190 and the multiple transport roller pairs 19 are constituent elements of a transport section 2.

In the transport of the recording paper P, a predetermined amount of deflection is created in the recording paper P by a registration roller pair 33 (an example of each transport roller pair 19) and a transport roller pair 193 (an example of each transport roller pair 19), and then the subsequent transport of the recording paper P is performed. The registration roller pair 33 is located on the upstream side in the transport direction of the recording paper P with respect to the above-mentioned nip part N between the image forming section 12 and the secondary transfer roller 210. The transport roller pair 193 is located further on the upstream side in the transport direction of the recording paper P with respect to the registration roller pair 33.

The paper feeding section 14 includes a manual feed tray 141, and the paper feed cassettes 142, 143, and 144. The manual feed tray 141 is located on the right side wall of the apparatus body 11 in FIG. 1 so as to be opened and closed. A pickup roller 145 is located above each of the paper feed cassettes 142, 143, and 144 and feeds the uppermost sheet of a bundle of recording paper P stored in each of the paper feed cassettes 142, 143, and 144 toward the transport path 190.

The fixing section 13 applies a fixing process to the toner image on the recording paper P, which has been transferred in the image forming section 12, by applying heat from a heat roller 132 while the recording paper P passes through a fixing nip part between the heat roller 132 and a pressure roller 134. The recording paper P that has completed the fixing process and has a color image formed thereon is discharged toward a discharge tray 151 through a discharge transport path 194 (a part of the transport path 190) that extends from an upper part of the fixing section 13.

The paper discharge section 15 includes the discharge tray 151. The recording paper P on which a toner image has been formed in the image forming section 12 is discharged to the discharge tray 151 after undergoing a fixing process in the fixing section 13.

When forming an image on both sides of recording paper P by the image forming section 12, first, the controller 100 causes the recording paper P with an image formed on its one side in the image forming section 12, to be pinched by a discharge roller pair 159 provided on the discharge tray 151 side. Thereafter, the controller 100 causes the transport direction of the recording paper P to be reversed by the discharge roller pair 159. Then, the controller 100 feeds the recording paper P to a reverse transport path 195 that branches out from the discharge transport path 194 and forms a part of the transport path 190. The controller 100 then transports the recording paper P again to an upstream area in the transport direction of the recording paper P with respect to the nip part N and the fixing section 13, by means of the transport roller pairs 19 provided at various locations on the reverse transport path 195. As a result, an image is formed on the other side of the recording paper P by the image forming section 12.

Figure 2:
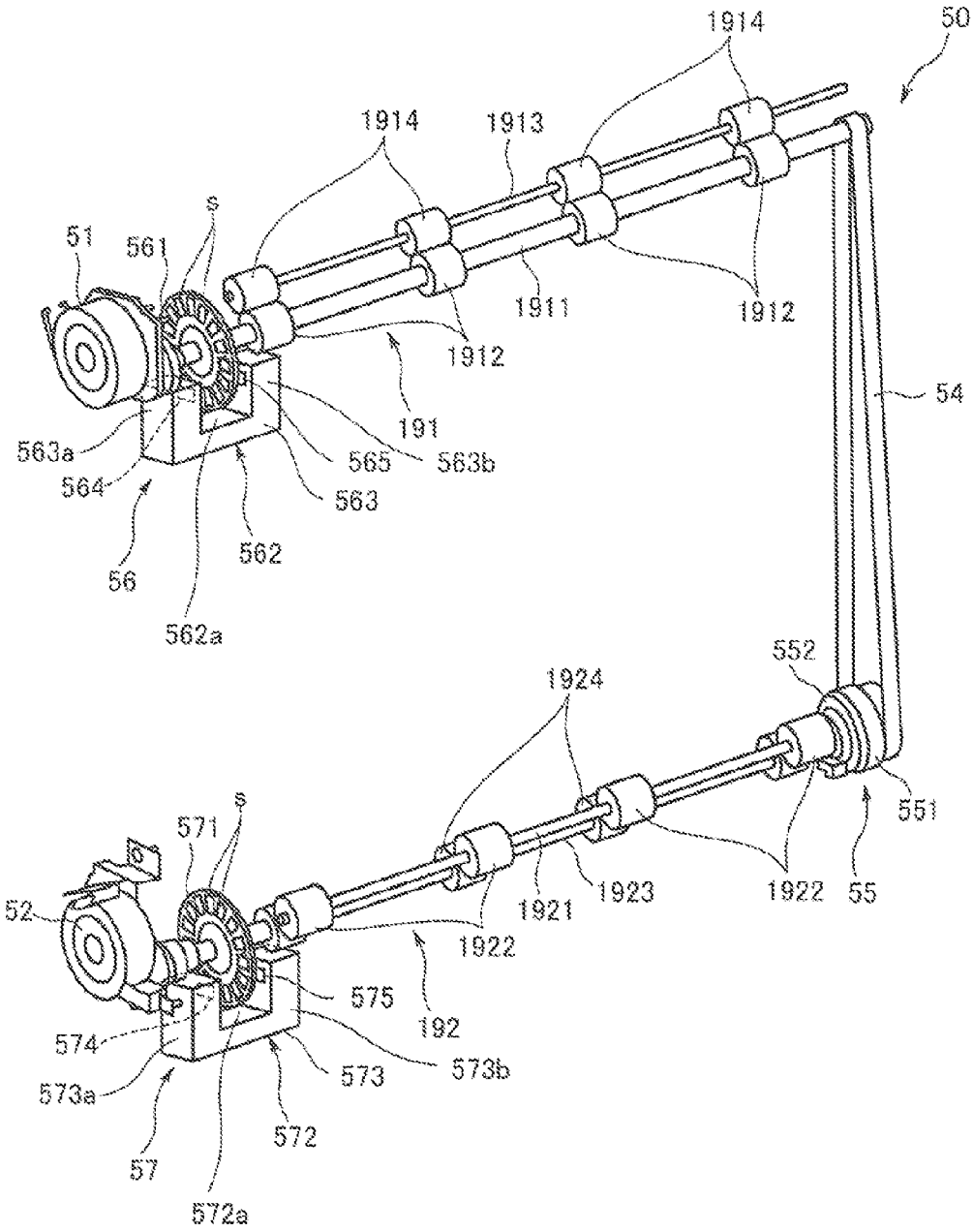
FIG. 2 illustrates a rotational speed control mechanism.
Figure 3A:
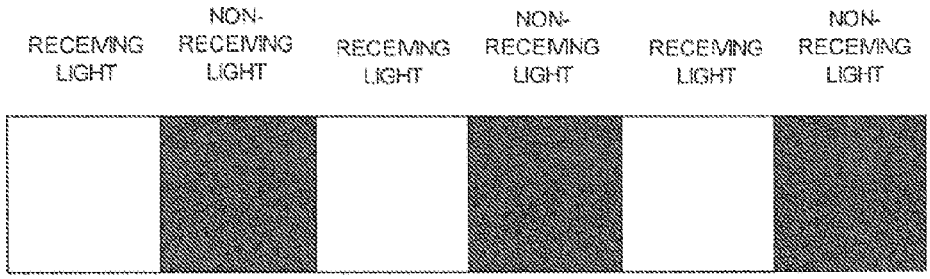
FIG. 3A illustrates states of light reception by an optical sensor.
Figure 3B:
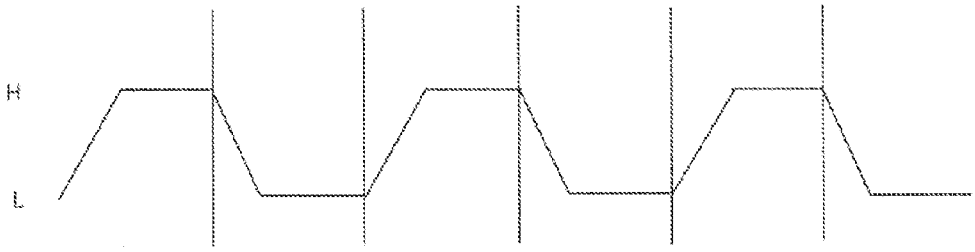
FIG. 3B illustrates a pulse signal outputted from the optical sensor.

Next, a rotational speed control mechanism 50 for controlling the rotational speeds of the transport roller pairs 19 located in the image forming apparatus 1 will be described. FIG. 2 is a perspective view of the rotational speed control mechanism 50. FIG. 3A illustrates states of light reception by an optical sensor, and FIG. 3B illustrates a pulse signal outputted from the optical sensor.

The reverse transport path 195 is provided with the rotational speed control mechanism 50. The rotational speed control mechanism 50 controls the rotational speeds of two transport roller pairs 19, that is, transport roller pairs 191 and 192 illustrated in FIG. 1, among the multiple transport roller pairs 19 provided in the reverse transport path 195. In the transport direction of the recording paper P, the transport roller pair 191 is positioned on the upstream side, and the transport roller pair 192 is positioned on the downstream side.

The rotational speed control mechanism 50 includes the transport roller pairs 191 and 192, stepping motors 51 and 52, a connecting member 54, a drive switching section 55, and encoders 56 and 57.

The stepping motor 51 is a driving source that transmits a rotational drive force to the transport roller pair 191. The drive of the stepping motor 51 is controlled by the controller 100. The stepping motor 52 is separate from the stepping motor 51, as a driving source that transmits a rotational drive force to the transport roller pair 192. The drive of the stepping motor 52 is also controlled by the controller 100.

The rotating shaft (not illustrated) of the stepping motor 51 is connected to one rotating shaft 1911 of the transport roller pair 191 so as to transmit a rotational drive force to the rotating shaft 1911. The rotating shaft 1911 has rollers 1912 attached at different positions along its length. The rollers 1912 transport the recording paper P while in contact with the recording paper P.

Another rotating shaft 1913 of the transport roller pair 191 is provided opposite to the rotating shaft 1911 and the rollers 1912. The rotating shaft 1913 is rotated by a rotational drive force transmitted to the rotating shaft 1913 from the stepping motor 51 via the rotating shaft 1911 and the rollers 1912. The rotating shaft 1913 has rollers 1914 located opposite to the rollers 1912 mentioned above. The rotating shafts 1911 and 1913 are supported on the apparatus body 11 in a state in which their rollers 1914 and 1912 are in contact with each other. As the rotational shafts 1911 and 1913 are rotated by the rotational drive force from the stepping motor 51, the transport roller pair 191 transports the recording paper P pinched at the nip part between the rollers 1912 and 1914, in the rotational direction of the rotating shafts 1911 and 1913.

The rotating shaft 1911 is provided with the encoder 56. The encoder 56 includes a pulse plate 561, and an optical sensor 562.

The pulse plate 561 is attached to the rotating shaft 1911 so that it has the same rotation center as the rotating shaft 1911. The pulse plate 561 is disc-shaped, and has multiple slits S formed at equal distances from one another along the peripheral edge of the pulse plate 561. These multiple slits S have the same shape.

The optical sensor 562 includes an outer case 563. The outer case 563 includes a case side part 563*a*, a case side part 563*b* that is located opposite to the case side part 563*a*, and a connecting part that connects the lower end part of the case side part 563*a* and the lower end part of the case side part 563*b*. A recess 562*a* is defined by the case side part 563*a*, the case side part 563*b*, and the connecting part. The optical sensor 562 is positioned so that a part of the peripheral edge part of the pulse plate 561 is located inside the recess 562*a* in a non-contact state.

The case side part 563*a* includes a light emitting section 564 located opposite to one side surface of the pulse plate 561. The light emitting section 564 has a LED, and emits light toward the slits S of the pulse plate 561.

The case side part 563*b* includes a light receiving section 565 located opposite to the other side surface of the pulse plate 561. The light receiving section 565 has a photo interrupter. The light receiving section 565 is located at a position in the case side part 563*b* which allows the light receiving section 565 to receive light emitted by the light emitting section 564 toward the slits S of the pulse plate 561. The light receiving section 565 receives light that has passed through the slits S, among the beams of light emitted to the pulse plate 561 by the light emitting section 564. The light receiving section 565 converts the received light into an electrical signal, and outputs the electrical signal to a rotational speed calculating section 101 (see FIG. 4) of a control unit 10. The above-mentioned encoders 56 and 57, and the rotational speed calculating section 101 constitute an example of the rotational speed detecting section.

Assuming that the rotating shaft 1911 and the pulse plate 561 are rotating at a constant speed by the rotational drive of the stepping motor 51, as illustrated in FIG. 3A, every time each of the slits S of the pulse plate 561 passes between the light emitting section 564 and the light receiving section 565, the light receiving section 565 receives light passing through the corresponding slit S. Consequently, as illustrated in FIG. 3B, the amount of light received by the light receiving section 565 increases every time each of the slits S passes between the light emitting section 564 and the light receiving section 565, and when the light finishes passing through the corresponding slit S, an electrical signal indicating a decrease in the amount of light received by the light receiving section 565 is outputted from the light receiving section 565 to the rotational speed calculating section 101. That is, the light receiving section 565 generates a pulse signal every time the light receiving section 565 receives light that has passed through each of the slits S. When the light receiving section 565 outputs a pulse signal to the rotational speed calculating section 101 as mentioned above, the rotational speed calculating section 101 detects the rotational speed of the transport roller pair 191 (rotating shaft 1911), based on the number of pulse signals received within a predetermined period of time.

Like the transport roller pair 191, the transport roller pair 192 includes a rotating shaft 1921, rollers 1922, a rotating shaft 1923, rollers 1924, the stepping motor 52, and the encoder 57 (which is configured in the same manner as the encoder 56) having a pulse plate 571 and an optical sensor 572. The optical sensor 572 includes a recess 572*a*, an outer case 573 (case side parts 573*a* and 573*b*), a light emitting section 574, and a light receiving section 575. The rotating shaft 1923 is also rotated by a rotational drive force transmitted to the rotating shaft 1923 from the stepping motor 52.

The connecting member 54 is an endless belt. The connecting member 54 is stretched around the respective rotating shafts 1911 and 1921 of the transport roller pairs 191 and 192 and moves. For example, the connecting member 54 is made of a material such as rubber or urethane that has a large friction coefficient with respect to its attaching parts on the rotating shafts 1911 and 1921 that are made of a material such as metal or synthetic resin. Because the connecting member 54 is stretched around the rotating shafts 1911 and 1921, the connecting member 54 can transmit the rotational drive force of one of the transport roller pairs 191 and 192 to the other transport roller pair. As a result, the transport roller pairs 191 and 192 are rotated at nearly the same rotational speed.

The drive switching section 55 is formed by a clutch or the like. The drive switching section 55 is attached to one of the transport roller pairs 191 and 192, which in this embodiment is the transport roller pair 192 located on the downstream side in the transport direction of the recording paper P. The drive switching section 55 is attached to the rotating shaft 1921, and the connecting member 54 is stretched around the peripheral surface of the drive switching section 55. That is, the connecting member 54 is stretched around the transport roller pair 192 (rotating shaft 1921) via the drive switching section 55.

The drive switching section 55 has a rotating part 551 around which the connecting member 54 is stretched, and a base part 552 that is attached to the rotating shaft 1921. Due to the controller 100, the drive switching section 55 switches between a state in which the rotating part 551 and the base part 552 rotate independently, and a state in which the rotating part 551 and the base part 552 are integrated so that the rotating part 551 and the base part 552 rotate together with the rotating shaft 1921. When the rotation is synchronized, each of the transport roller pairs 191 and 192 transmits its rotational drive force to the other transport roller pair. For example, when the transport roller pair 192 is rotating slower than the transport roller pair 191, as the rotational drive force supplied from the stepping motor 51 to the transport roller pair 191 is transmitted to the transport roller pair 192, the transport roller pairs 191 and 192 can be rotated at nearly the same rotational speed. When the transport roller pair 192 is rotating faster than the transport roller pair 191, as the rotational drive force supplied from the stepping motor 52 to the transport roller pair 192 is transmitted to the transport roller pair 191, the transport roller pairs 191 and 192 can be rotated at nearly the same rotational speed.

In this embodiment, by means of switching control of the drive switching section 55 by the controller 100 in accordance with the rotational speeds of the transport roller pairs 191 and 192, the rotational speed control mechanism 50 switches whether or not to rotate the transport roller pairs 191 and 192 at nearly the same speed by transmitting a rotational drive force to one of the transport roller pairs 191 and 192 from the other transport roller pair through connection of the transport roller pairs 191 and 192 by the connecting member 54, thereby controlling the rotational speeds of the transport roller pairs 191 and 192. Details of this rotation control will be described later.

Figure 4:
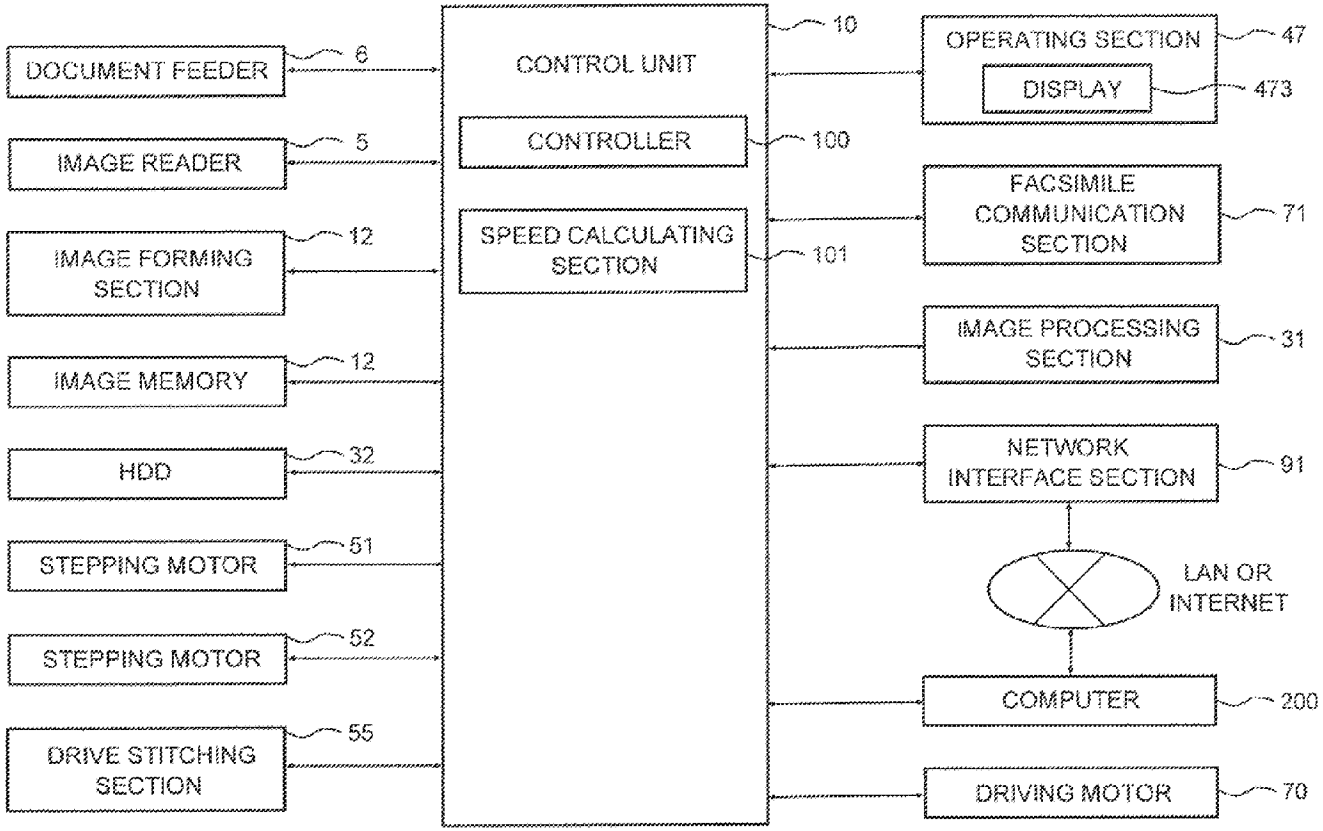
FIG. 4 is a functional block diagram illustrating a configuration of a image forming apparatus.

Next, a configuration of the image forming apparatus 1 will be described. FIG. 4 is a block diagram illustrating a configuration of the image forming apparatus 1.

The image forming apparatus 1 includes the control unit 10. The control unit 10 is configured by a CPU, a RAM, a ROM, a dedicated hardware circuit, and the like. The control unit 10 is responsible for controlling the general operation of the image forming apparatus 1.

The image reader 5 includes the above-mentioned reading mechanism 163 having a light-irradiation section, a CCD sensor, and the like. The image reader 5 irradiates a document with light by using the light-irradiation section, and receives light reflected from the document by using the CCD sensor, thereby reading an image from the document.

An image processing section 31 performs image processing as required on the image data of an image read by the image reader 5. For example, in order to improve the quality of an image formed by the image forming section 12 based on image data read by the image reader 5, the image processing section 31 performs predetermined image processing such as shading correction on the image data.

An image memory 32 is an area that temporarily records the data of a document image obtained by reading by the image reader 5, or temporarily saves data that is subject to printing by the image forming unit 12.

The image forming unit 12 forms an image based on print data read by the image reader 5, print data received from a computer 200 connected to a network, or the like.

The operating section 47 accepts instructions from an operator with respect to various operations and processing that can be executed by the image forming apparatus 1. The operating section 47 includes the display 473.

A facsimile communication section 71 includes an encoder/decoder, a modulator and demodulator, and a NCU (which are not illustrated). The facsimile communication section 71 performs facsimile transmission and reception by using a public telephone network.

A network interface section 91 is configured by a communication module such as a LAN board. The network interface section 91 transmits and receives various data to and from the computer 200 or the like within a local area, via a LAN or the like connected to the network interface section 91.

The HDD 92 is a mass storage device that stores document images and the like read by the image reader 5.

As described above, the stepping motors 51 and 52 supply rotational drive forces to the transport roller pairs 191 and 192, respectively.

The drive switching section 55 has the function of switching whether or not to rotate the transport roller pair 192 together with the transport roller pair 191 by connection of the transport roller pairs 191 and 192 by the connecting member 54, under drive control by the controller 100.

A driving motor 70 transmits a rotational drive force to various rotating members of the image forming unit 12, the transport rollers 19 other than the transport roller pairs 191 and 192, and the like.

The control unit 10 includes the controller 100 and the rotational speed calculating section 101.

The controller 100 is connected to the image reader 5, the document feeder 6, the image processing section 31, the image memory 32, the image forming section 12, the operating section 47, the facsimile communication section 71, the network interface section 91, the HDD 92, the stepping motors 51 and 52, the drive switching section 55, and the like. The controller 100 controls these sections.

The rotational speed calculating section 101 calculates the respective rotational speeds of the transport roller pairs 191 and 192 based on the detection signals outputted from the respective light receiving sections 565 and 575 of the encoders 56 and 57 mentioned above.

Further, when the rotational speed of at least one of the transport roller pairs 191 and 192 calculated by the rotational speed calculating section 101 falls outside a predetermined speed range (which will be described in detail later), the controller 100 causes the drive switching section 55 to switch to a state in which the transport roller pairs 192 rotate together with the transport roller pairs 191.

The recording medium transport device 30 according to an embodiment of the present disclosure includes the reverse transport path (an example of transport path) 195, the rotational speed control mechanism 50, the controller 100, and the rotational speed calculating section 101. The recording medium transport device 30 is a constituent element of the transport section 2.

Figure 5:
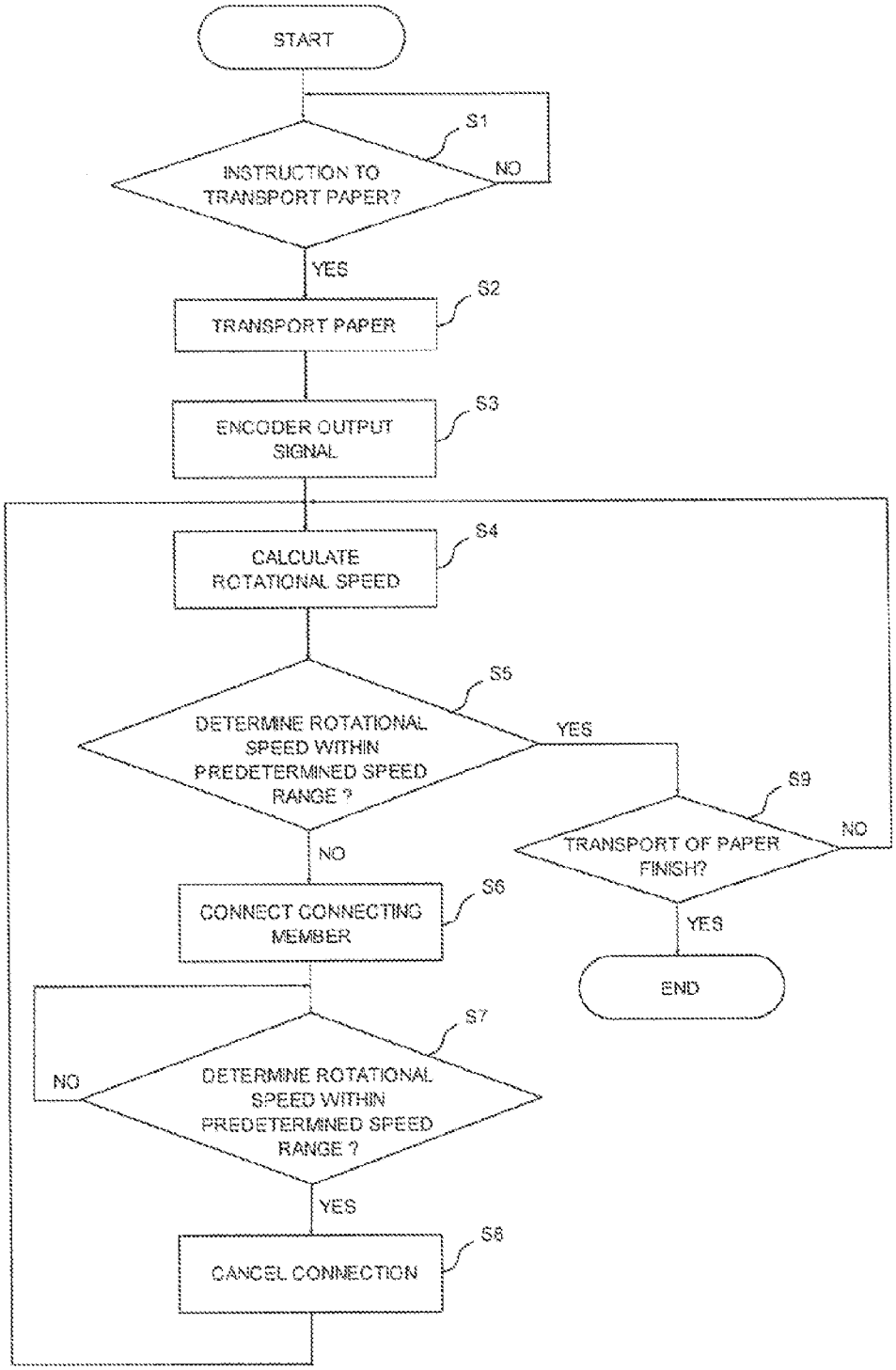
FIG. 5 is a flowchart illustrating processing performed at the time of controlling transport of recording paper in the image forming apparatus.
Figure 6:
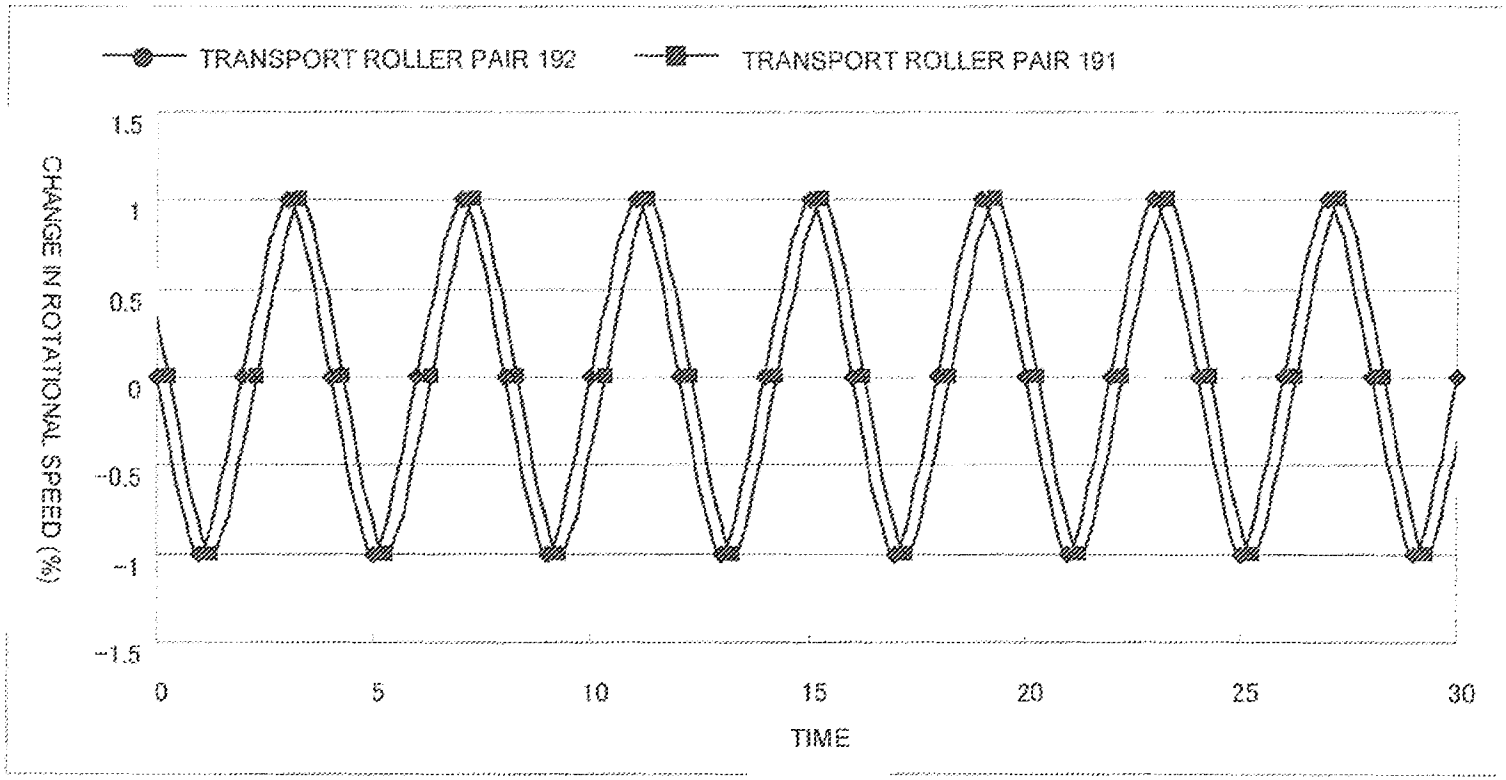
FIG. 6 illustrates changes in the rotational speeds of two transport roller pairs.

Next, an embodiment of processing that is performed at the time of controlling transport of recording paper P in the image forming apparatus 1 will be described. FIG. 5 is a flowchart illustrating processing that is performed at the time of controlling transport of recording paper P in the image forming apparatus 1. FIG. 6 illustrates changes in the rotational speeds of the transport roller pairs 191 and 192.

When an instruction to transport recording paper P is inputted, upon an instruction to execute a copy operation by an operator (YES in S1), the controller 100 drives the driving motor 70 to start transport of recording paper P by the transport roller pairs 19 at a predetermined transport speed at which the recording paper P is to be transported during image forming operation (S2).

As described above, in the transport of the recording paper P, a predetermined amount of deflection is created in the recording paper P by the registration roller pair 33 and the transport roller pair 193 located upstream of the registration roller pair 33 in the transport direction of the recording paper P, and then the subsequent transport of recording paper P is performed.

Now, a situation where a duplex print job is inputted by the operator will be described. That is, the controller 100 controls the drive of the driving motor 70 of the above-mentioned transport roller pairs 19 so that recording paper P to which an image has been formed on its one side in the image forming section 12 is pinched by the discharge roller pair 159. Thereafter, the controller 100 makes the transport direction of the recording paper P reverse by the discharge roller pair 159, and the recording paper P to be fed to the reverse transport path 195. Then, the controller 100 makes the recording paper P transport again to an upstream area in the transport direction of the recording paper P with respect to the above-mentioned nip part N and the fixing section 13, by means of the transport roller pairs 19 located at various locations on the reverse transport path 195. As a result, an image is formed on the other side of the recording paper P by the image forming section 12.

During transport of the recording paper P, the encoders 56 and 57 output pulse signals corresponding to the rotational speeds of the transport roller pairs 191 and 192 (S3), respectively. The rotational speed calculating section 101 acquires the above-mentioned pulse signals from the encoders 56 and 57 during transport of the recording paper P.

The rotational speed calculating section 101 calculates the rotational speeds of the transport roller pairs 191 and 192 based on the pulse signals acquired from the encoders 56 and 57, respectively (S4).

The controller 100 then determines whether or not each of the rotational speeds of the transport roller pairs 191 and 192 calculated by the rotational speed calculating section 101 falls within a predetermined speed range (S5). This predetermined speed range is the range of speeds that lie within a fixed range with respect to a reference speed. The reference speed is the rotational speed of each of the transport roller pairs 191 and 192 corresponding to the predetermined recording paper transport speed mentioned above. For example, the predetermined speed range is a speed range within rotation change rate of ±1% with respect to the above-mentioned reference speed.

When it is determined by the controller 100 that the detected rotational speed of one of the transport roller pairs 191 and 192 mentioned above does not fall within the above-mentioned predetermined speed range (NO in S5), the controller 100 causes the drive switching section 55 to switch to a state in which the transport roller pairs 191 and 192 are connected via the connecting member 54 (S6).

As a result, one of the transport roller pairs 191 and 192 whose rotational speed falls outside the above-mentioned predetermined speed range is connected to the other transport roller pair and rotates in synch with the other transport roller. In this connected state, the transport roller pair whose rotational speed has changed rotates while receiving a supplementary rotational drive force from the other transport roller pair. As a result, the respective rotational speeds of the two transport roller pairs 191 and 192 that are connected and rotate become nearly the same.

Therefore, it is possible to rotate the two transport roller pairs 191 and 192 at nearly the same speed, without performing a motor control as to increase the number of excited phases with an increase in required torque as in the conventional technique. As a result, it is possible to prevent a step out of the stepping motors 51 and 52, in particular, a step out of the stepping motor corresponding to the transport roller pair whose rotational speed has changed, by preventing an increase in the load on the stepping motors 51 and 52 due to pulling or pushing of the recording paper P resulting from a difference between the rotational speeds of the two transport roller pairs 191 and 192, without causing an increase in the power consumption or a rise in temperature of the stepping motors 51 and 52.

That is, according to the rotational speed control for the transport roller pairs 191 and 192 through connection of the transport roller pairs 191 and 192 by the connecting member 54 mentioned above, as illustrated in FIG. 6, even when the rotational speed of one of the transport roller pairs changes, the rotational speed of the transport roller pair follows the rotational speed of the other transport roller pair, with the result that the rotational speeds of the transport roller pairs 191 and 192 are maintained at nearly the same speed from the beginning to the end of the rotational drive. Therefore, even when the recording paper P is pushed into the transport roller pairs 191 and 192, or the recording paper P is pulled by the transport roller pairs 191 and 192, and a change occurs in the rotational speed of the transport roller pair 191 or 192, it is possible to resolve this speed change and continue the subsequent recording paper transport.

After the above-mentioned connection of the transport roller pairs 191 and 192, when the rotational speed of the one of the transport roller pairs 191 and 192 which had fallen outside the above-mentioned predetermined speed range returns to a speed that falls within the predetermined speed range (YES in S7), the controller 100 causes the drive switching section 55 to cancel the connection between the transport roller pairs 191 and 192 (S8). On the other hand, when the rotational speed of the one of the transport roller pairs 191 and 192 which had fallen outside the predetermined speed range does not return to a speed that falls within the predetermined speed range, the controller 100 causes the drive switching section 55 to maintain the connection of the transport roller pairs 191 and 192 via the connecting member 54, until the rotational speed of the one of the transport roller pairs 191 and 192 returns to a speed that falls within the predetermined speed range (NO in S7).

In this way, the connection between the transport roller pairs 191 and 192 via the connecting member 54 is cancelled when the rotational speed of one of the transport roller pairs 191 and 192 returns to a speed that falls within a predetermined speed range. Accordingly, except for when it is necessary to assist one transport roller pair, the control returns to the normal rotational speed control of the transport roller pairs 191 and 192 by the controller 100. Therefore, it is possible to minimize the load exerted on the stepping motor corresponding to the other transport roller pair from which a rotational drive force is transmitted to the one transport roller pair.

When the controller 100 determines in step S5 mentioned above that the rotational speeds of the transport roller pairs 191 and 192 falls within the predetermined speed range (YES in S5), the processes in S4 and S5 are repeated until transport of all the sheets of recording paper P indicated by the above-mentioned print job is finished (NO in S9, and S4 and S5). When transport of all the sheets of recording paper P indicated by the above-mentioned print job is finished, the controller 100 causes the processing to end (YES in S9).

In the above-mentioned rotational speed control of the transport roller pairs 191 and 192, one of the transport roller pairs 191 and 192 which rotates while receiving a supplementary rotational drive force from the other transport roller pair also receives a rotational drive force from the stepping motor provided for this transport roller pair. Therefore, the transmission of a rotational drive force from the other transport roller pair by the connecting member 54 is done only in a supplementary way, and thus causes only a limited increase in the load exerted on the stepping motor corresponding to the other transport roller pair from which the rotational drive force is transmitted.

Equalizing the rotational speeds of the transport roller pairs 191 and 192 by connecting the transport roller pairs 191 and 192 by the connecting member 54 as mentioned above is accomplished by transmitting a rotational drive force to one transport roller pair from the other transport roller pair by the connecting member 54. Therefore, the effect of external disturbances or the like on the rotational speeds of the transport roller pairs 191 and 192 is small. As a result, the rotational speeds of the two transport roller pairs 191 and 192 can be made substantially the same reliably, which contributes to preventing a step out of the stepping motors 51 and 52.

The present disclosure is not limited to the above-mentioned embodiment but may be modified in various ways. For example, in the above-mentioned embodiment, when the speed of one of the transport roller pairs 191 and 192 changes and falls outside a predetermined speed range with reference to the above-mentioned reference speed, the controller 100 performs a connection control that either connects or disconnects the transport roller pairs 191 and 192 by the drive switching section 55. However, the controller 100 may be configured to perform the above-mentioned connection control when the speed change occurs in a predetermined one of the transport roller pairs 191 and 192. In this case, only the transport roller pair for which the speed change is to be detected may be provided with an encoder.

The above-mentioned embodiment may be configured so that when the rotational speed of one of the transport roller pairs 191 and 192 which is detected by the rotational speed calculating section 101 falls outside the above-mentioned predetermined speed range, the controller 100 causes the drive switching section 55 to switch the transport roller pairs 191 and 192 into a connected state, and increases, by a predetermined value, the driving current that is used to drive the stepping motor provided to the other transport roller pair different from the transport roller pair of which the speed change has occurred. The predetermined value used is, for example, a current value that is determined in advance in accordance with the amount of torque that needs to be increased in order to assist the transport roller pair of which the above-mentioned speed change has occurred.

In the above-mentioned embodiment, the rotational speed control mechanism 50 is disposed for the transport roller pairs 191 and 192 provided in the reverse transport path 195, and a rotational speed control is performed for the transport roller pairs 191 and 192. However, the present disclosure is not limited to this. A rotational speed control may be performed for any two transport roller pairs provided in the transport path 190.

The present disclosure is not limited to the above-mentioned embodiment but may be modified in various ways. For example, while in the above-mentioned embodiment a multifunctional peripheral is used as an example of the image forming apparatus according to the present disclosure, this is merely illustrative. Another type of image forming apparatus, for example, a printer, a copier, or a facsimile apparatus may be used.

The configuration and processing according to the embodiment described above with reference to FIGS. 1 to 6 are merely illustrative of an embodiment of the present disclosure, and not intended to limit the present disclosure to the above configuration and processing.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A recording medium transport device comprising:

a transport path along which a recording medium is transported;

two transport roller pairs, that are located at different positions on the transport path in a transport direction of the recording medium, and transport the recording medium;

two stepping motors, that are provided for each one of the two transport roller pairs respectively, and supply a rotational drive force to the relevant transport roller pairs;

a rotational speed detecting section configured to detect a rotational speed of at least one of the two transport roller pairs;

a connecting member configured to connect the two transport roller pairs;

a drive switching section, that is provided to one of the two transport roller pairs and is configured to switch between a state in which the rotational drive force is transmitted between the two transport roller pairs via the connecting member and a state in which the rotational drive force is not transmitted between the two transport roller pairs; and a controller configured to cause the drive switching section to switch from the state in which the rotational drive force is not transmitted between the two transport roller pairs to the state in which the rotational drive force is transmitted between the two transport roller pairs via the connecting member, when the rotational speed detected by the rotational speed detecting section falls outside a predetermined speed range.

2. The recording medium transport device according to claim 1, wherein after the drive switching section switches from the state in which the rotational drive force is not transmitted between the two transport roller pairs to the state in which the rotational drive force is transmitted between the two transport roller pairs via the connecting member, when it is confirmed that a rotational speed of at least one of the two transport roller pairs of which the rotational speed detected by the rotational speed detecting section has fallen outside the predetermined speed range falls within the predetermined speed range, the controller causes the drive switching section to switch from the state in which the rotational drive force is transmitted between the two transport roller pairs via the connecting member to the state in which the rotational drive force is not transmitted between the two transport roller pairs.

3. The recording medium transport device according to claim 1, wherein when causing the drive switching section to switch from the state in which the rotational drive force is not transmitted between the two transport roller pairs to the state in which the rotational drive force is transmitted between the two transport roller pairs via the connecting member, the controller increases a driving current by a predetermined value, the driving current being used to drive the stepping motor provided to one of the two transport roller pairs whose rotational speed detected by the rotational speed detecting section does not fall outside the predetermined speed range.

4. The recording medium transport device according to claim 1, wherein the connecting member is an endless belt that is stretched around and moves between the two transport roller pairs to connect and rotate the two transport roller pairs.

5. An image forming apparatus comprising:

a paper feeding section configured to feed a recording medium to a transport section;

the transport section configured to transport the recording medium fed from the paper feeding section, the transport section including a recording medium transport device; and an image forming section configured to form a toner image on the recording medium transported by the transport section, wherein the recording medium transport device includes a transport path along which a recording medium is transported, two transport roller pairs configured to transport the recording medium, the two transport roller pairs being located at different positions on the transport path in a transport direction of the recording medium, two stepping motor, that are provided for each one of the two transport roller pairs respectively, and supply a rotational drive force to the relevant transport roller pairs, a rotational speed detecting section configured to detect a rotational speed of at least one of the two transport roller pairs, a connecting member configured to connect the two transport roller pairs, a drive switching section, that is provided to one of the two transport roller pairs and is configured to switch between a state in which the rotational drive force is transmitted between the two transport roller pairs via the connecting member and a state in which the rotational drive force is not transmitted between the two transport roller pairs, and a controller that configured to cause the drive switching section to switch from the state in which the rotational drive force is not transmitted between the two transport roller pairs to the state in which the rotational drive force is transmitted between the two transport roller pairs via the connecting member, when the rotational speed detected by the rotational speed detecting section falls outside a predetermined speed range.

6. The image forming apparatus according to claim 5, wherein after the drive switching section switches from the state in which the rotational drive force is not transmitted between the two transport roller pairs to the state in which the rotational drive force is transmitted between the two transport roller pairs via the connecting member, when it is confirmed that a rotational speed of at least one of the two transport roller pairs of which the rotational speed detected by the rotational speed detecting section has fallen outside the predetermined speed range falls within the predetermined speed range, the controller causes the drive switching section to switch from the state in which the rotational drive force is transmitted between the two transport roller pairs via the connecting member to the state in which the rotational drive force is not transmitted between the two transport roller pairs.

7. The image forming apparatus according to claim 5, wherein when causing the drive switching section to switch from the state in which the rotational drive force is not transmitted between the two transport roller pairs to the state in which the rotational drive force is transmitted between the two transport roller pairs via the connecting member, the controller increases a driving current by a predetermined value, the driving current being used to drive the stepping motor provided to one of the two transport roller pairs whose rotational speed detected by the rotational speed detecting section does not fall outside the predetermined speed range.

8. The image forming apparatus according to claim 5, wherein the connecting member is an endless belt that is stretched around and moves between the two transport roller pairs to connect and rotate the two transport roller pairs.

* * * * *